US012589839B2

(12) United States Patent
Erickson

(10) Patent No.: US 12,589,839 B2
(45) Date of Patent: Mar. 31, 2026

(54) AQUATIC BODYBOARD FOLDING CHAIR

(71) Applicant: Andrew Everett Erickson, Kamuela, HI (US)

(72) Inventor: Andrew Everett Erickson, Kamuela, HI (US)

( * ) Notice: Subject to any disclaimer, the term of this patent is extended or adjusted under 35 U.S.C. 154(b) by 119 days.

(21) Appl. No.: 18/678,471

(22) Filed: May 30, 2024

(65) Prior Publication Data

US 2025/0236363 A1 Jul. 24, 2025

Related U.S. Application Data

(60) Provisional application No. 63/622,974, filed on Jan. 19, 2024.

(51) Int. Cl.
*B63B 32/22* (2020.01)
*A47C 4/00* (2006.01)
*B63B 32/50* (2020.01)

(52) U.S. Cl.
CPC ..... *B63B 32/22* (2020.02); *A47C 4/00* (2013.01); *B63B 32/50* (2020.02)

(58) Field of Classification Search
CPC ..... A47C 1/146; A47C 1/14; A47C 15/006; B32B 32/22
See application file for complete search history.

(56) References Cited

U.S. PATENT DOCUMENTS 5,439,405 A * 8/1995 Storey ..... B63B 34/50 441/127

FOREIGN PATENT DOCUMENTS

BR 102015026180 A2 * 5/2017 ..... B63B 32/00
BR 102018001627 A2 * 8/2019 ..... A47C 13/00

* cited by examiner

*Primary Examiner* — Eric J Kurilla
(74) *Attorney, Agent, or Firm* — David R. Heckadon; Gordon Rees Scully Mansukhani LLP

(57) ABSTRACT

A device that may be converted between an aquatic bodyboard and a beach chair, having front and rear bodyboard panel portions that are pivotally connected together and a folding mechanism that rotates the front and rear bodyboard panel portions with respect to one another. The folding mechanism includes legs and armrests that rotate and lock into openings in either of the front and rear panels when the device is being used as an aquatic bodyboard. Armrest supports may be used to lock the armrests into position when the device is in the chair position to keep the chair in an open position.

15 Claims, 20 Drawing Sheets

AQUATIC BODYBOARD FOLDING CHAIR

RELATED APPLICATION

The present application claims priority to U.S. Provisional Patent Application Ser. No. 63/622,974, entitled Bodyboard Folding Chair, filed Jan. 19, 2024, the entire disclosure of which is incorporated herein by reference in its entirety for all purposes.

TECHNICAL FIELD

The present invention relates to aquatic bodyboards.

BACKGROUND OF THE INVENTION

Embarking on a day at the beach is always exciting. Unfortunately, the struggle of lugging many items across long distances of sandy and often uneven terrain can quickly make the experience less enjoyable. Two of the more commonly desired beach essentials are beach chairs and flotation devices. Unfortunately, each of these items tend to be heavy, bulky and difficult to carry. It would instead be desirable to provide an easier way to transport both of these items to the beach. Ideally, such a solution would not compromise the aquatic performance of the bodyboard or the comfort of the beach chair.

SUMMARY OF THE INVENTION

The present system provides a fully functional, floating aquatic bodyboard that can be quickly converted into a beach chair, and then back into an aquatic bodyboard as desired. A folding mechanism is included which permits legs and armrests of the beach chair to be received into out-of-the-way openings in the sides and/or end of the bodyboard when the device is being used as a bodyboard.

In preferred aspects, the present system provides a combination aquatic bodyboard and beach chair system, comprising: a bodyboard front panel portion; a bodyboard rear panel portion pivotally connected to the bodyboard front panel portion; and a folding mechanism configured to move the front and rear panel portions between a flat bodyboard position and an angled chair position. The front and rear bodyboard panel portions are co-planar when the system is in the flat bodyboard position and angled to one another to form a seat with a back support when the system is in the angled chair position.

In its chair position, the front portion of the bodyboard acts as the back of the chair and the rear portion of the bodyboard acts as the seat of the chair. The advantage of the present system is that it is a space-saving, versatile and enjoyable solution for beach enthusiasts. The present system provides enhanced portability as the user only has to carry one device instead of separately carrying an aquatic bodyboard and a beach chair.

The mechanism for the transition between a bodyboard and a beach chair is simple to operate, easy and smooth. The bodyboard panels are preferably made out of standard buoyant materials such as extruded polypropylene to maintain optimal buoyancy and performance in aquatic environments. As a chair, the present system is stable and comfortable.

In preferred aspects, the folding mechanism includes a pivoting connection between the front and rear panel portions, a pair of armrests, and chair legs. Both the armrests and chair legs are received into openings in the side edges of one or the other of the front or rear panel portions when the system is in the flat bodyboard position. Rotatable armrest support members can also be included to lock the armrests into position. As will be further explained, the weight of the person sitting on the chair will tend to keep the chair in its locked open position.

In optional embodiments, the four leg members may be are connected together in pairs to form a front leg and a back leg that extend across underneath the chair. Both the front and back leg can be received into openings that also extend across the bottom and/or end of one or the other of the front or rear panel portions when the system is in the flat bodyboard position. For added stability, the front leg may angled out forwardly and the back leg may be angled out backwardly when the system is in its chair position.

DETAILED DESCRIPTION OF THE DRAWINGS

Figure 1A:
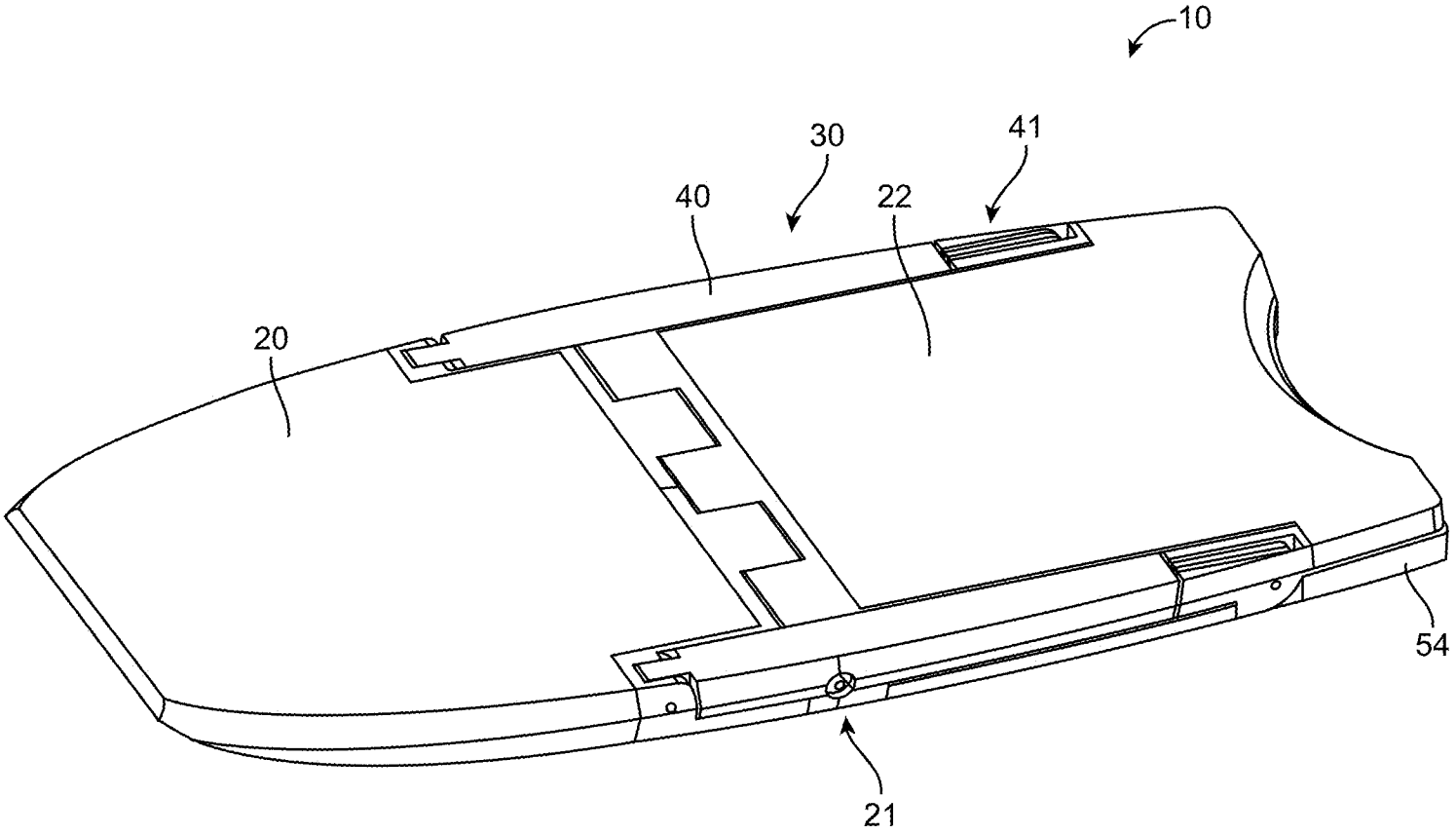
FIG. 1A is a top perspective view of the present system when operating as an aquatic bodyboard.
Figure 1B:
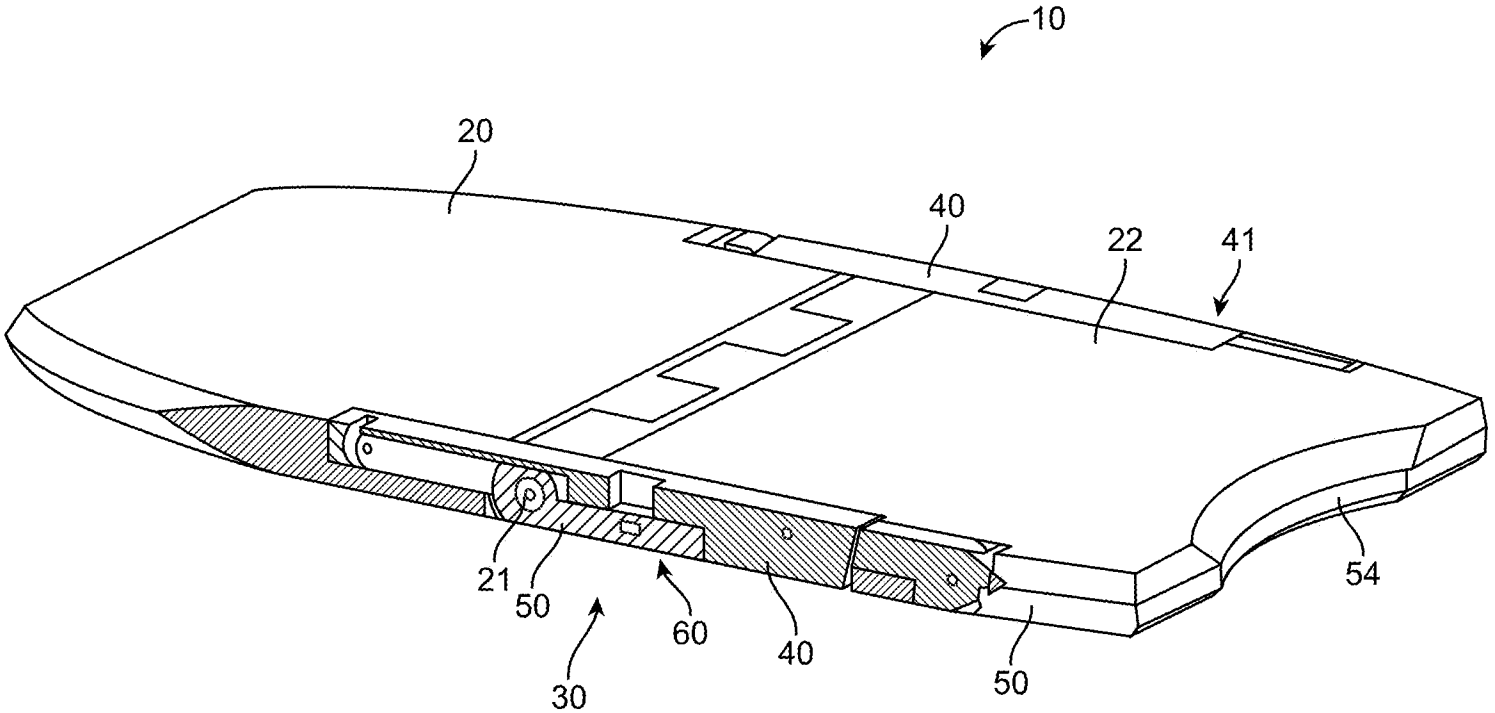
FIG. 1B corresponds to FIG. 1A, but instead shows a cross-sectional view through the device near its side edge to show operation of the various components. (Side edges of the device have been cut away to show operational details).
Figure 2:
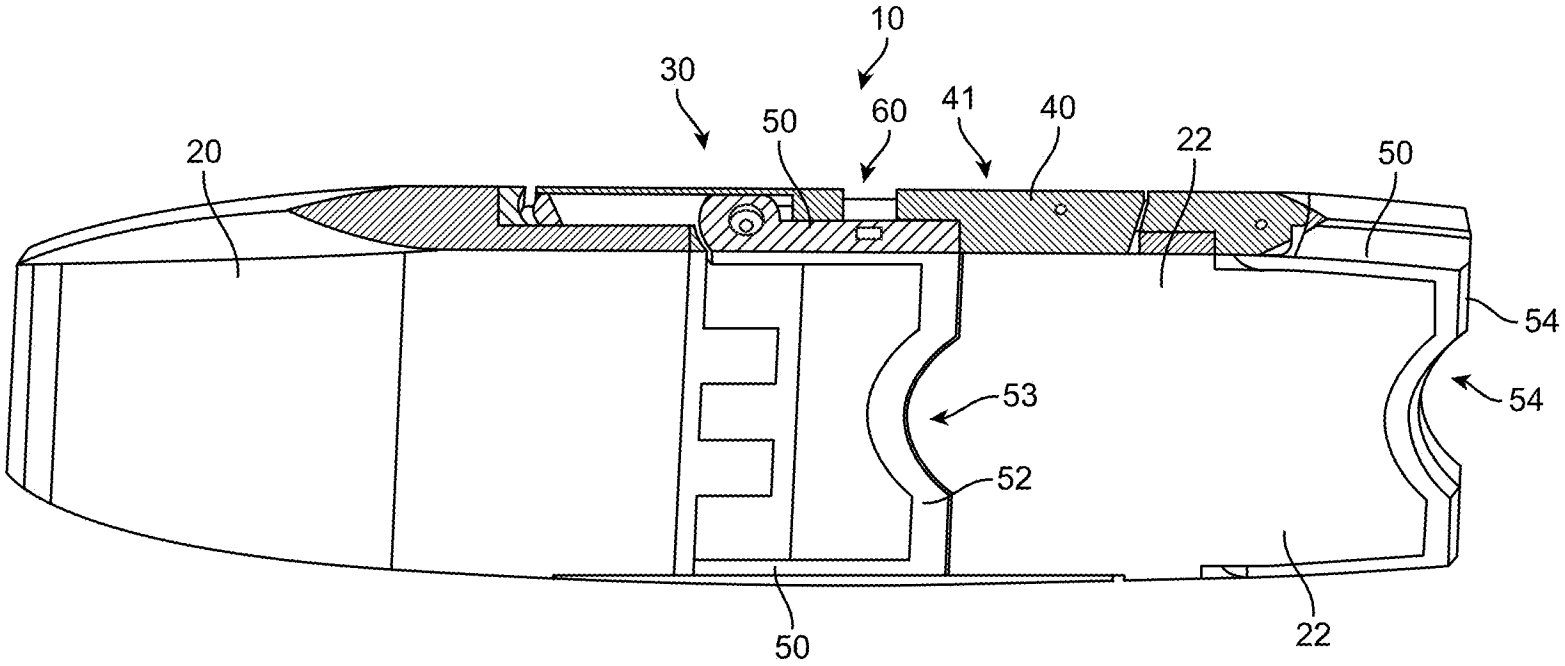
FIG. 2 is a bottom perspective view of the present system when operating as an aquatic bodyboard. (Side edges of the device have been cut away to show operational details).
Figure 3:
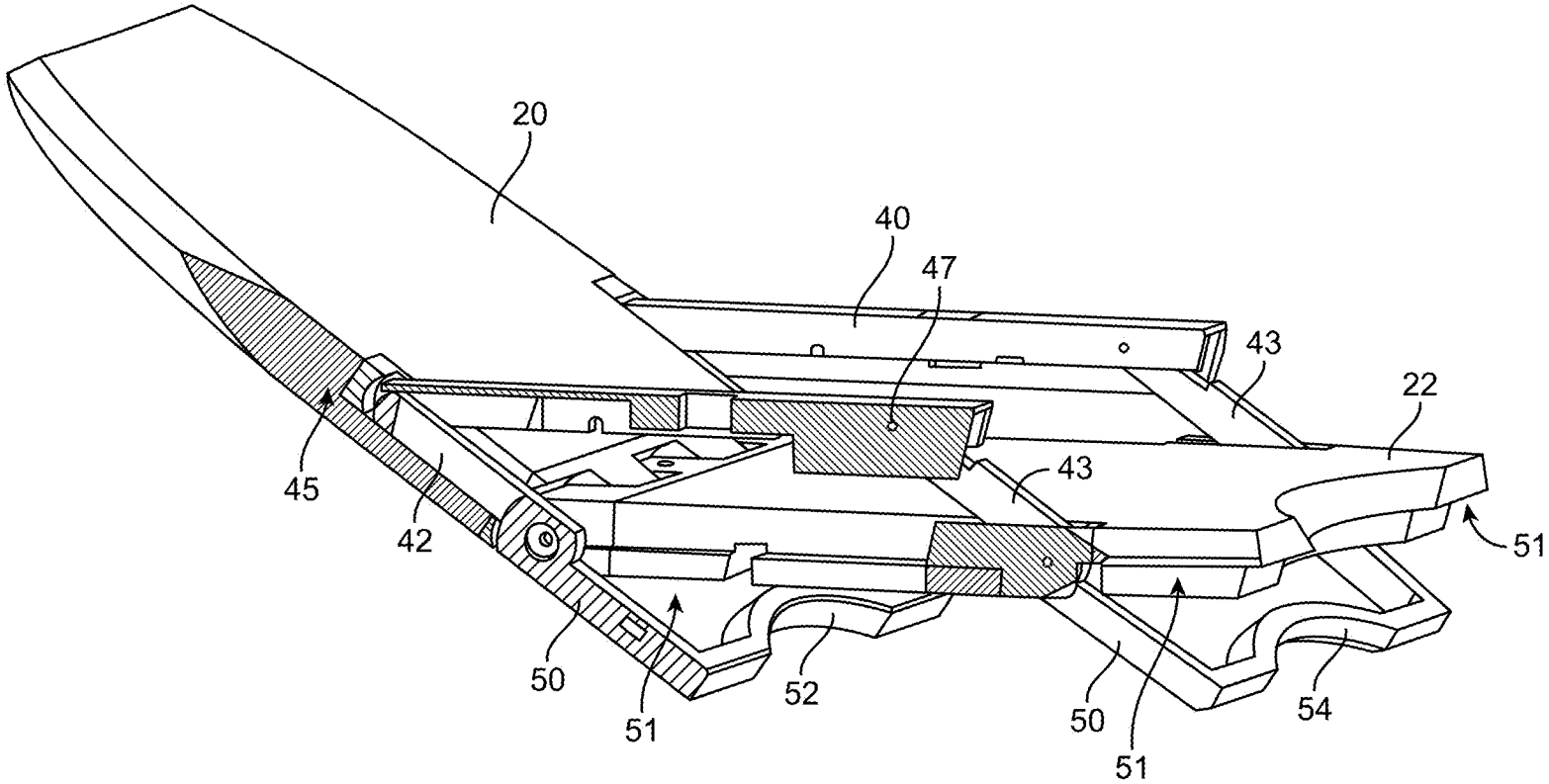
FIG. 3 is a side perspective view of the present system at a mid-way position while converting from a bodyboard to a beach chair. (Side edges of the device have been cut away to show operational details).
Figure 4:
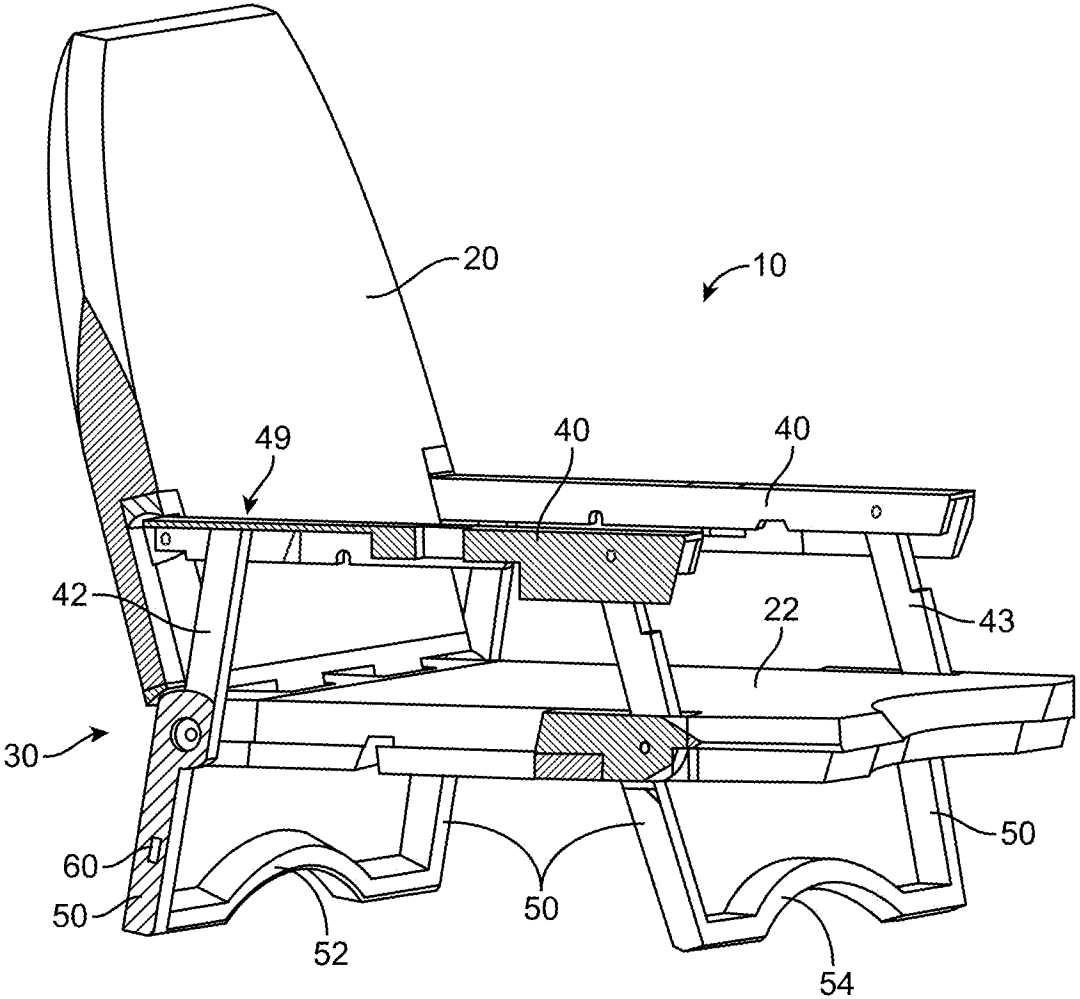
FIG. 4 is a front perspective view of the present system when operating as a beach chair. (Side edges of the device have been cut away to show operational details).

FIGS. 1A to 2 show the present device 10 when the device is operating as an aquatic bodyboard. FIG. 3 shows the device mid-way between the conversion from an aquatic bodyboard to a beach chair. FIG. 4 shows the final position of the device 10 when being used as a beach chair. The present device 10 may be converted back and forth between its flat planar bodyboard position (FIGS. 1A to 2) and its angled chair position (FIG. 4), and back and forth again and again, whenever it is desired to do so.

As seen in the attached FIGS. 1A to 5, combination bodyboard and chair device 10 comprises a bodyboard front panel portion 20 and a bodyboard rear panel portion 22 pivotally connected together at pivot point 21. In preferred aspects, bodyboard panel portions 20 and 22 may be made from extruded polypropylene, or other suitable lightweight, sturdy but buoyant material.

A folding mechanism 30 is configured to move the front and rear panel portions 20 and 22 between a flat bodyboard position of FIGS. 1 and 2 and the angled chair position of FIG. 4. As seen in FIGS. 1A to 2, the front and rear bodyboard panel portions 20 and 22 are co-planar when the system is in the flat bodyboard position, and angled to one another when the system is in the angled chair position. FIG. 3 shows a mid-way position when the device 10 is being converted from a bodyboard into a beach chair. FIG. 4 shows the device 10 after it has been fully converted into a beach chair.

Folding mechanism 30 comprises a pivoting connection at pivot point 21 between the bodyboard front and rear portions 20 and 22. As seen in FIG. 4, the folding mechanism 30 of chair 10 includes a pair of armrests 40 and leg members 50. As can also be seen the four leg members 50 can be connected together in pairs to form a front leg 54 and a back leg 52 for the chair.

Figure 5:
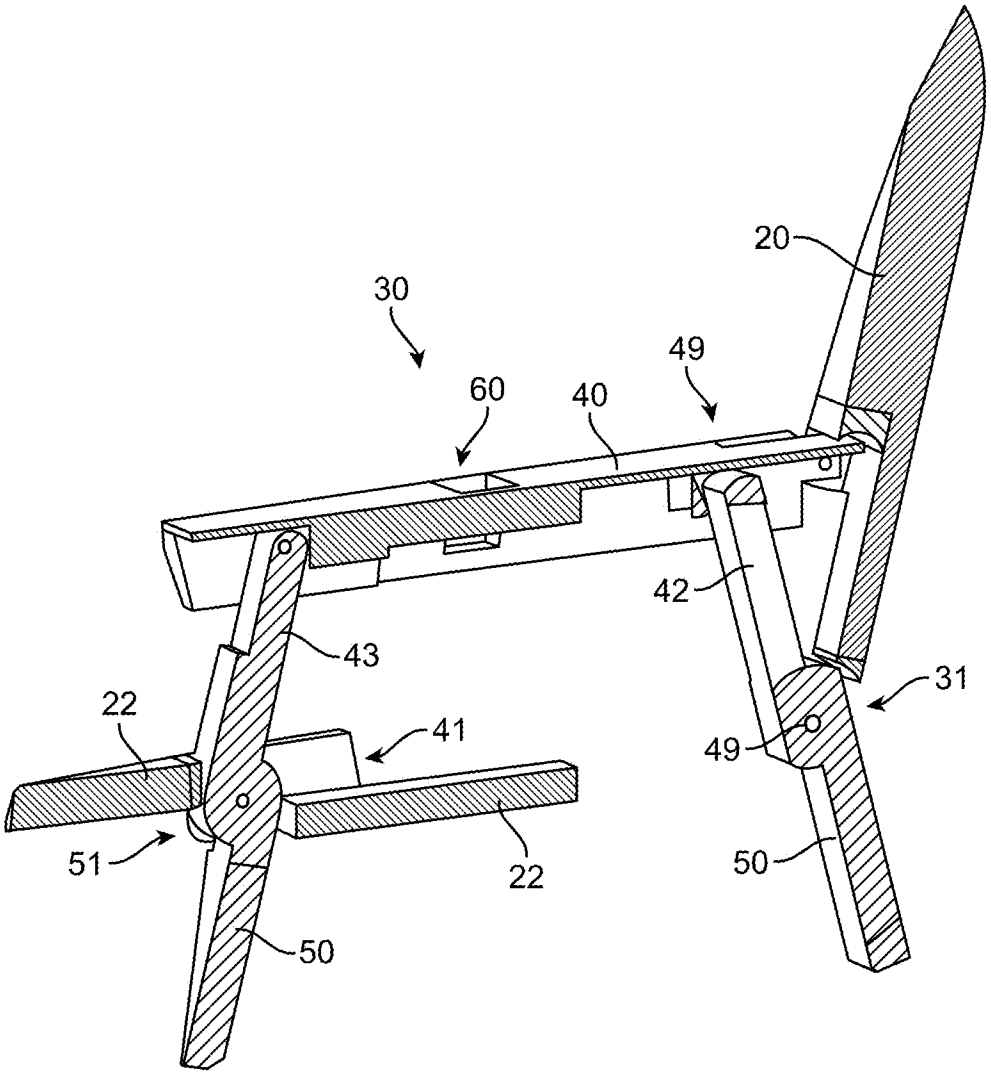
FIG. 5 is a side view of the present system with various components removed showing operation of the folding mechanism.

In accordance with this preferred embodiment of the present system, the armrests 40 are received into armrest openings 41 in one or the other of the front or rear panel portions 22 when the system is in the flat bodyboard position. FIG. 5 shows further details with some of the structural components removed for clarity of illustration. Specifically, armrest openings 41 are seen in the top of rear panel portion 22 (Note only a part of rear panel portion 22 is illustrated in FIG. 5). Armrest openings 41 are positioned at the side edges of rear panel 22. It is to be understood that in various embodiments, armrest openings 41 may be disposed in one or the other or both of the front or rear panel portions 20 or 22.

Similarly, the leg members 50 are received into leg openings 51 at side edges of one or the other of the front or rear panel portions 20 and 22 when the system is in the flat bodyboard position. As seen in FIG. 5, a leg member 50 at the front of the chair may rotate together with an armrest support member 43, and be formed from the same piece of material. Similarly, another leg member 50 at the back of the chair may rotate together with an armrest support member 42, and be formed from the same piece of material. In alternate embodiments, armrest rear support member 42 may be rotatable with respect to back leg member 50 around pivot point 49.

In preferred embodiments, folding mechanism 30 thus comprises: a pair of armrests 40, four armrest support members 42 and 43, and four leg members 50. As seen in FIG. 3, the four armrest support members 42 and 43 and the four leg members 50 are pivotally mounted to the bodyboard rear panel portion.

As seen in FIG. 2, front leg 54 may be received into an opening 54 and back leg 52 may be received into an opening 53, with openings 53 and 54 spanning across the bottom of the device 10, for example across the bottom of rear panel 22. In its collapsed bodyboard position (FIGS. 1A to 2), the armrests 40, armrest supports 42 and 43, leg members 50 and legs 52 and 54 are all received into cutaway portions of the bodyboard panels 20 and 22.

As best seen in FIGS. 4 and 5, front leg 54 may be angled out forwardly and the back leg 52 may be angled out backwardly when the system is in the angled chair position. This position gives the chair stability and prevents it from falling over.

As seen in FIGS. 3, 4 and 5, armrests 40 may be pivotally connected to bodyboard front portion 20 at pivot point 45 and to armrest support member 43 at pivot point 47. Armrests 40 and their associated armrest support members 42 and 43 are all received into the plane of the bodyboard when the device is in its collapsed bodyboard position. As best seen in FIGS. 4 and 5, armrest supports 42 are preferably rotated into a locked position under armrest 40. Specifically, the top ends of armrest supports 42 may have a pin that is rotated into a latched locked position at point 49 under armrest 40. As such, each rear armrest support members 42 may either move together with leg member 50 and be made out of the same block of material, or may be members 42 and 50 may be made of different blocks of material, both pivoting around pivot point 49, all keeping within the scope of the present invention. An advantage of having members 42 moveable with respect to members 50 is that members 42 can be rotated forwardly into the locked position seen in FIG. 5, without moving corresponding leg member 50.

In optional embodiments, a locking mechanism 60 is provided to secure at least one or both of the armrests 40 or armrest support members 42 or leg members 50 to the rear panel portion 22 when the system is in the flat bodyboard position. Locking mechanism 60 preferably comprises a button and latch mechanism on one or both sides of the device that requires the user to depress the button to release either or both of the armrests 40 or leg members 50 from the panel portion 22 of the device. Locking mechanism 60 prevents the armrests 40 and leg members 50 from accidently deploying while device 10 is being used as an aquatic bodyboard.

Figure 6:
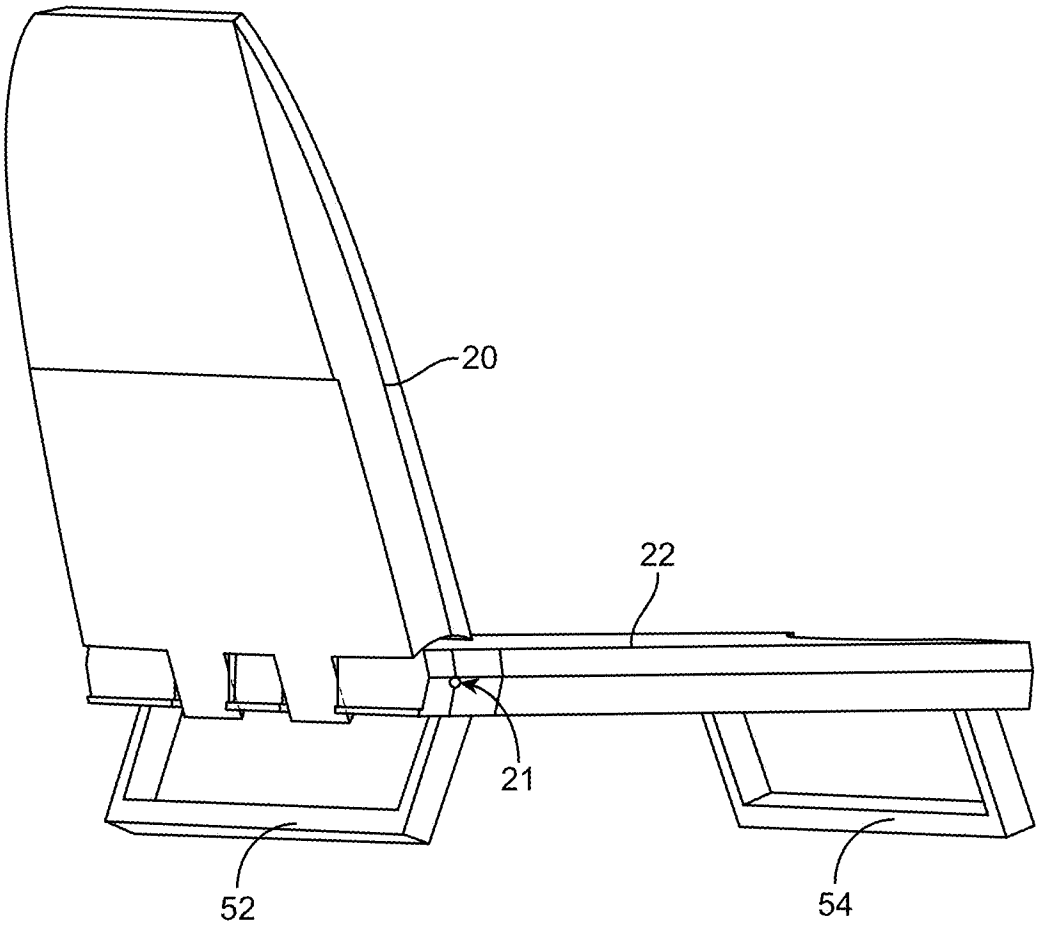
FIG. 6 is a rear perspective view of a second embodiment of the present system lacking armrests.
Figure 7:
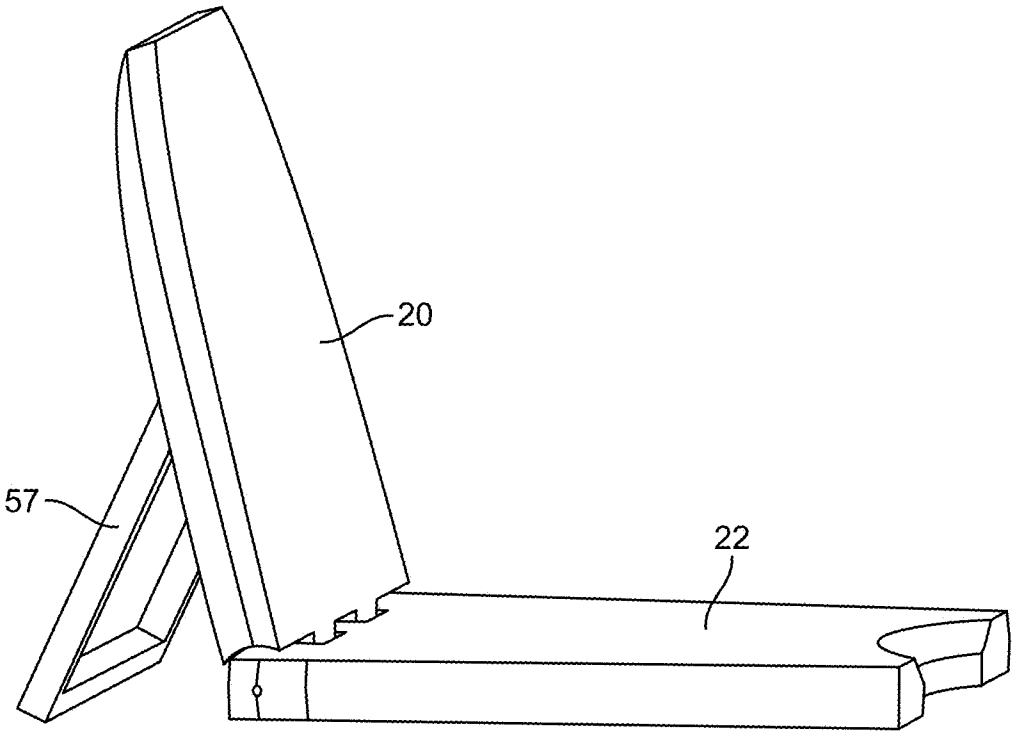
FIG. 7 is a front perspective view of a third embodiment of the present system, also lacking armrests.

FIGS. 6 and 7 set forth two alternate embodiments of the present system, both encompassed by the presently claimed invention, as follows. FIG. 6 shows bodyboard front and rear portions 20 and 22 connected together at pivot point 21. In accordance with this embodiment, no armrests are provided. Instead, panel portions 20 and 22 are shaped such that they rotate to the angle and position shown. A locking mechanism (not shown) can be used to hold front panel portion 20 in the illustrated angled chair position shown (or, alternately locked in the flat bodyboard position) such that it operates as the user's back support when the device is in its chair orientation as shown. In addition, foldable legs 52 and 54 can be rotated up into openings in the bottom side of rear panel portion 22 when the device is in its flat bodyboard position.

The optional embodiment shown in FIG. 7 is similar to FIG. 6, except that rear body portion 22 rests on the ground and a single leg 57 is used instead. Leg 57 is received into an opening in the bottom of panel portion 20 and optionally panel portion 22 as well (depending upon the exact length and positioning of leg 57 on front panel portion 20). A locking system (not shown) is used to hold bodyboard panel portions 20 and 22 in their flat orientation when the device is being used as an aquatic bodyboard.

Figure 8:
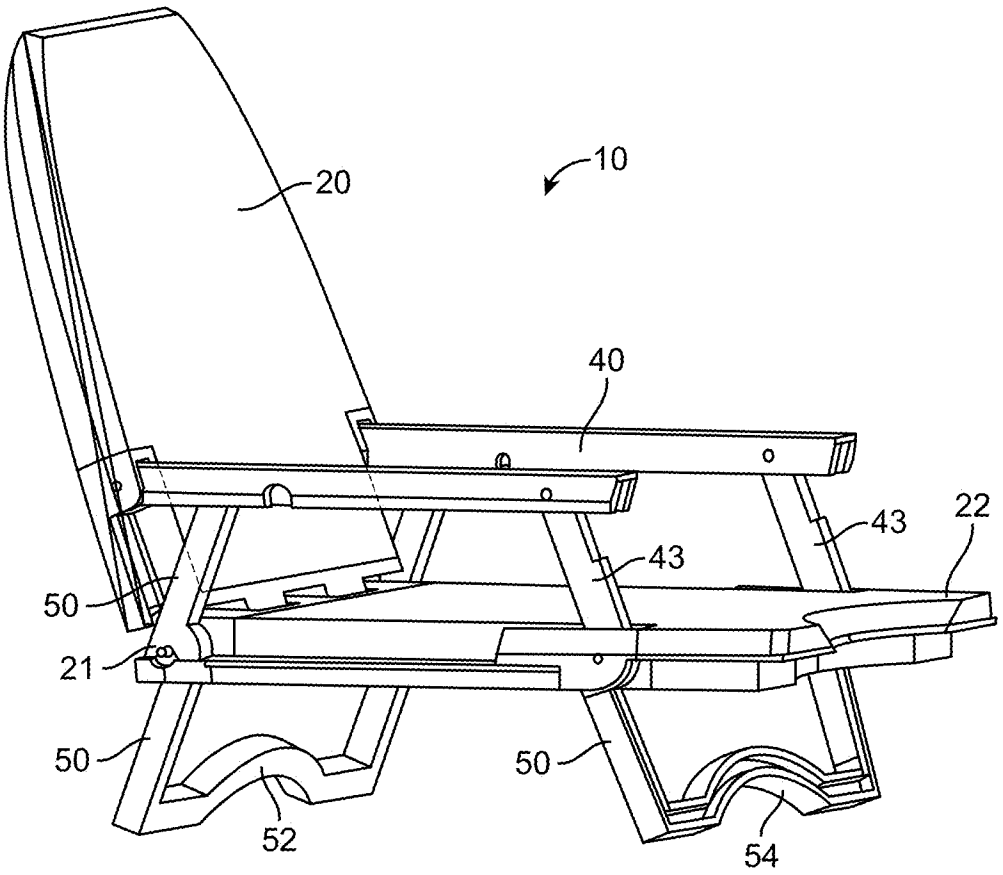
FIG. 8 is a side perspective of a fourth embodiment of the present system.
Figure 9A:
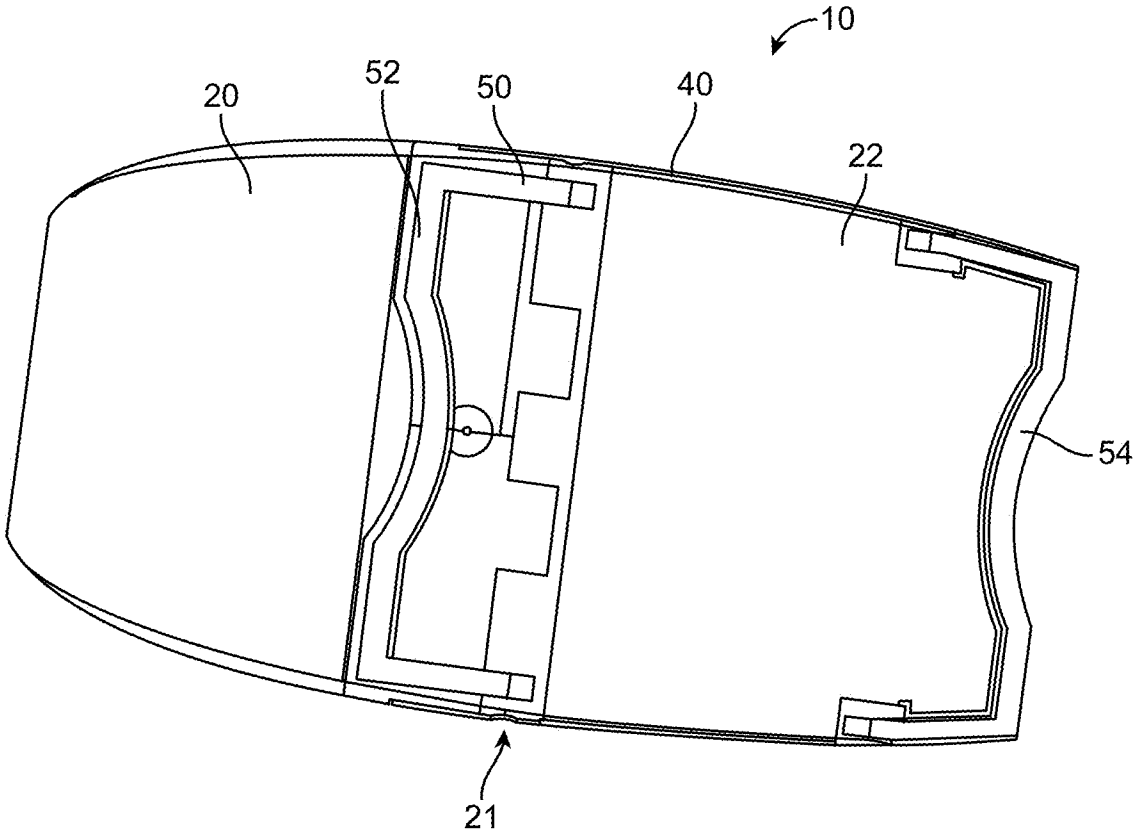
FIG. 9A corresponds to the embodiment of FIG. 8 in its bodyboard position.
Figure 9B:
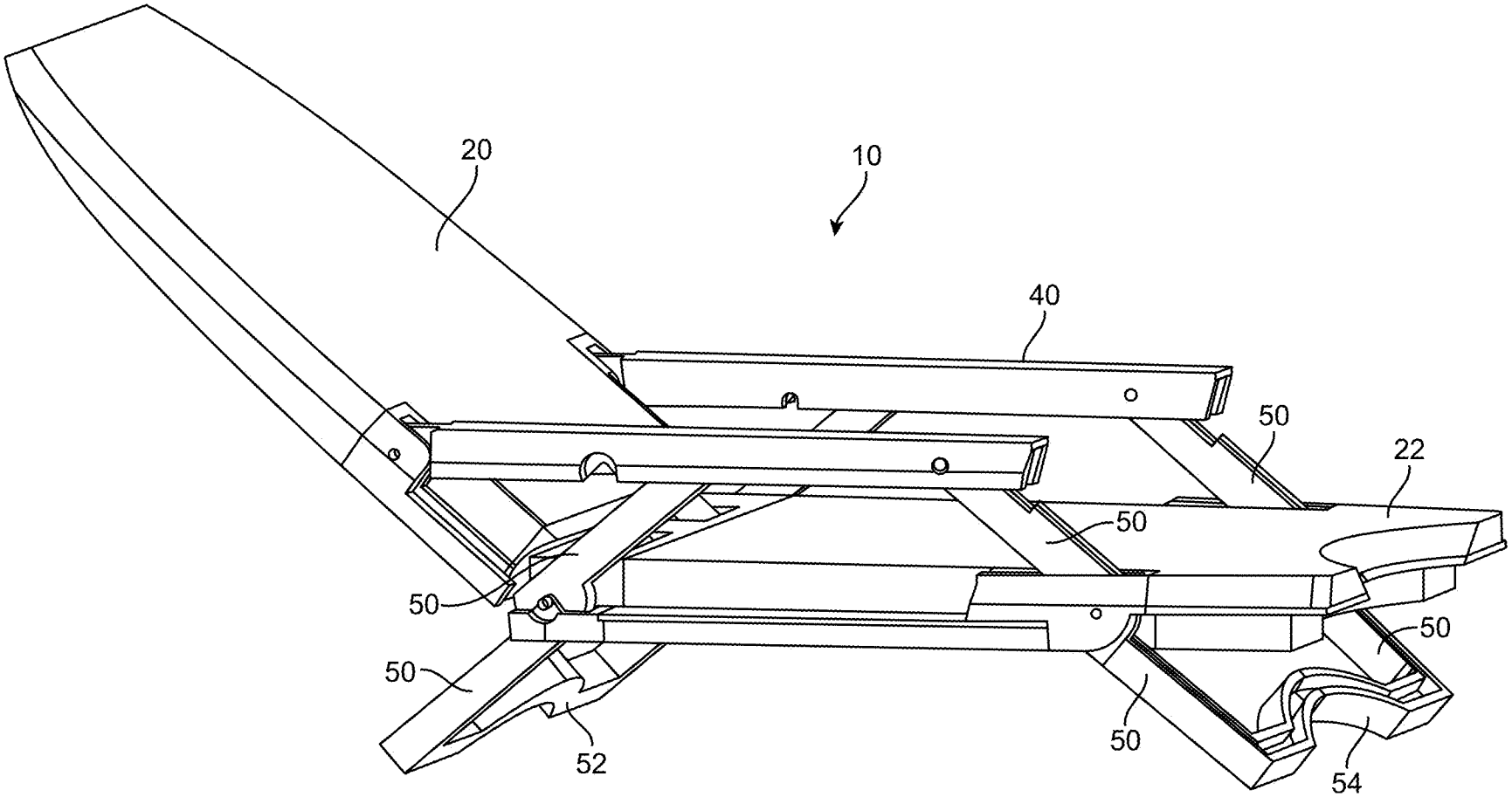
FIG. 9B is a side perspective of the chair of FIG. 8 in a mid-way position while converting from a bodyboard to a beach chair.
Figure 10:
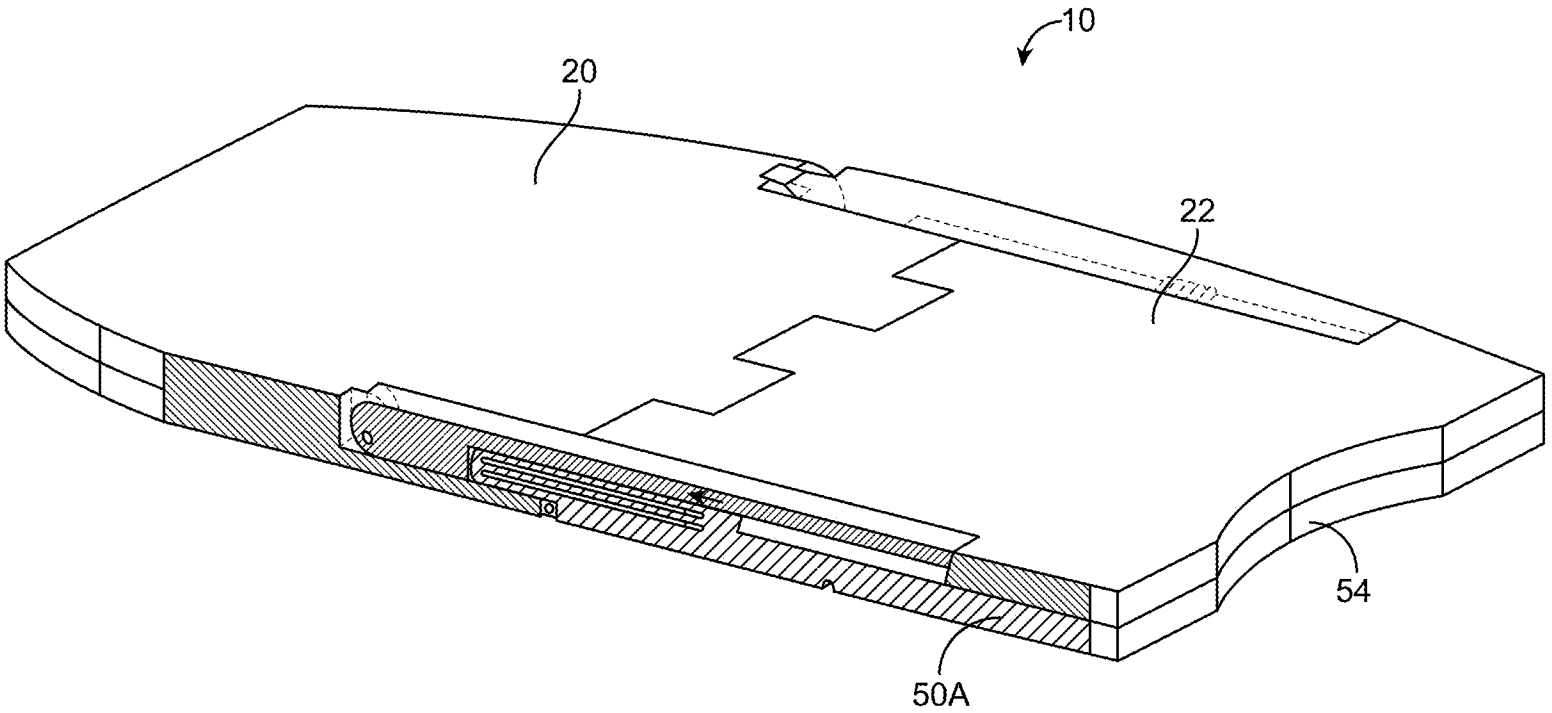
FIG. 10 is a side perspective view of a fifth embodiment of the present system in its bodyboard position. (Side edges of the device have been cut away to show operational details).

FIGS. 8 to 9B illustrate a fourth embodiment of the present system. In this embodiment, leg member 50 also extends upwardly and rotates into a locked position under armrest 40, thereby supporting armrest 40. As seen in FIG. 9A, therefore, rear leg 52 points in an opposite (i.e.: forward) direction as compared to the illustration of the embodiment of FIG. 2. FIG. 8 illustrates the chair position for this embodiment of the invention. FIG. 9A illustrates the bodyboard position and FIG. 9B illustrates the mi-way position, showing the rotation of the leg members 50 forming legs 52 and 54.

Figure 11:
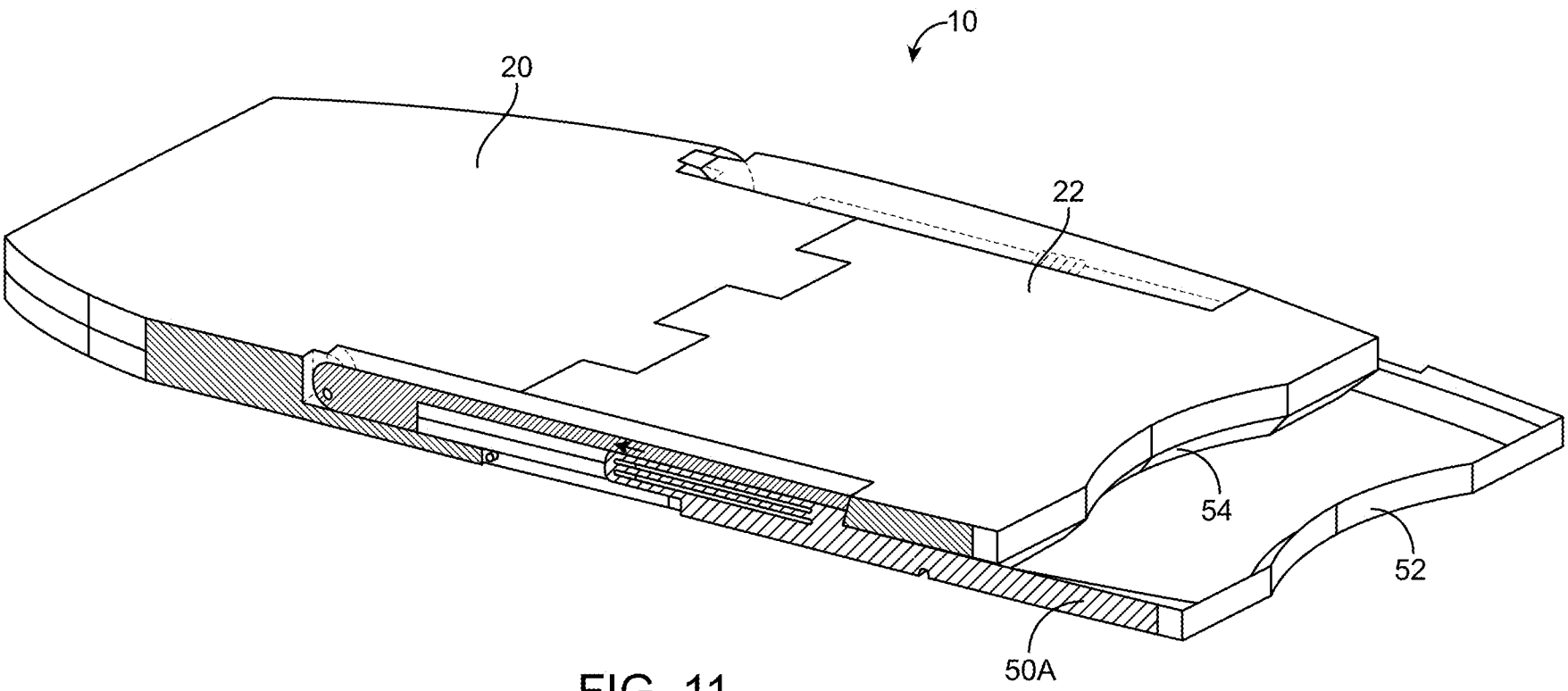
FIG. 11 is a top perspective view that corresponds to the embodiment of FIG. 10, but shows the initial steps in the deployment of the legs of the chair. (Side edges of the device have been cut away to show operational details).
Figure 12:
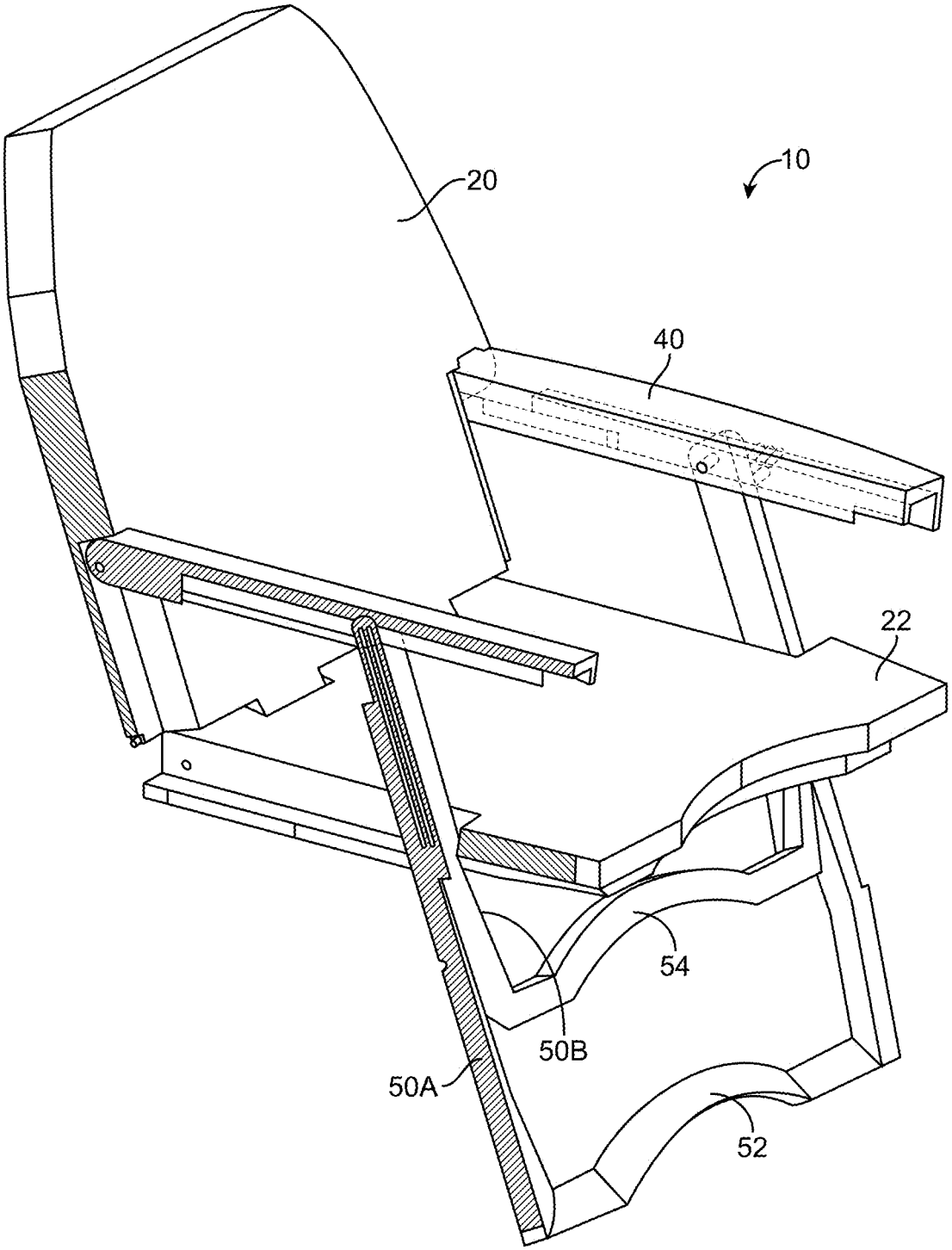
FIG. 12 is a front perspective view that corresponds to the embodiment of FIGS. 10 and 11, but farther in the deployment of the legs of the chair. (Side edges of the device have been cut away to show operational details).
Figure 13:
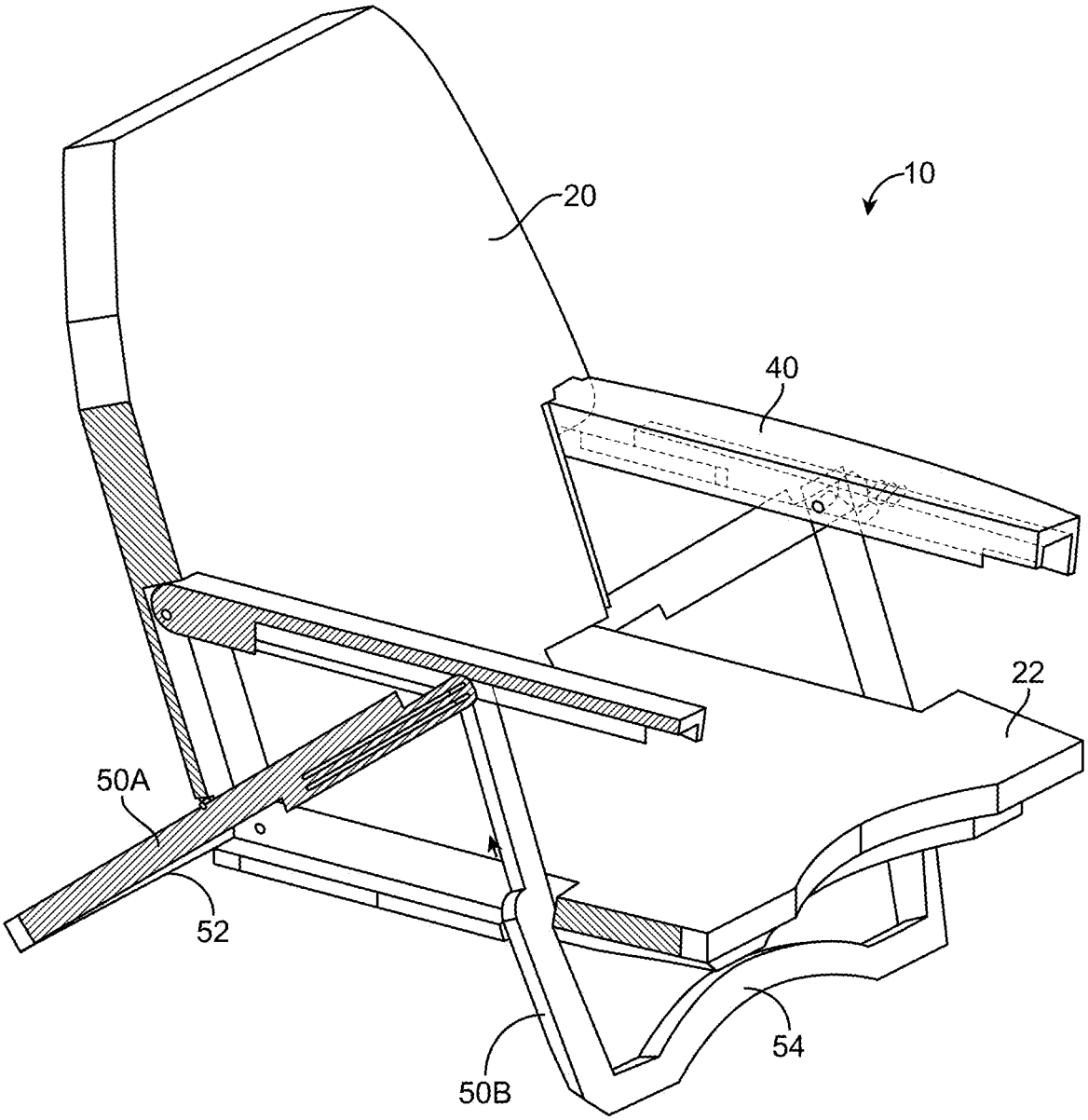
FIG. 13 is a front perspective view that corresponds to the embodiment of FIGS. 10 to 12, with the legs being fully deployed. (Side edges of the device have been cut away to show operational details).
Figure 14:
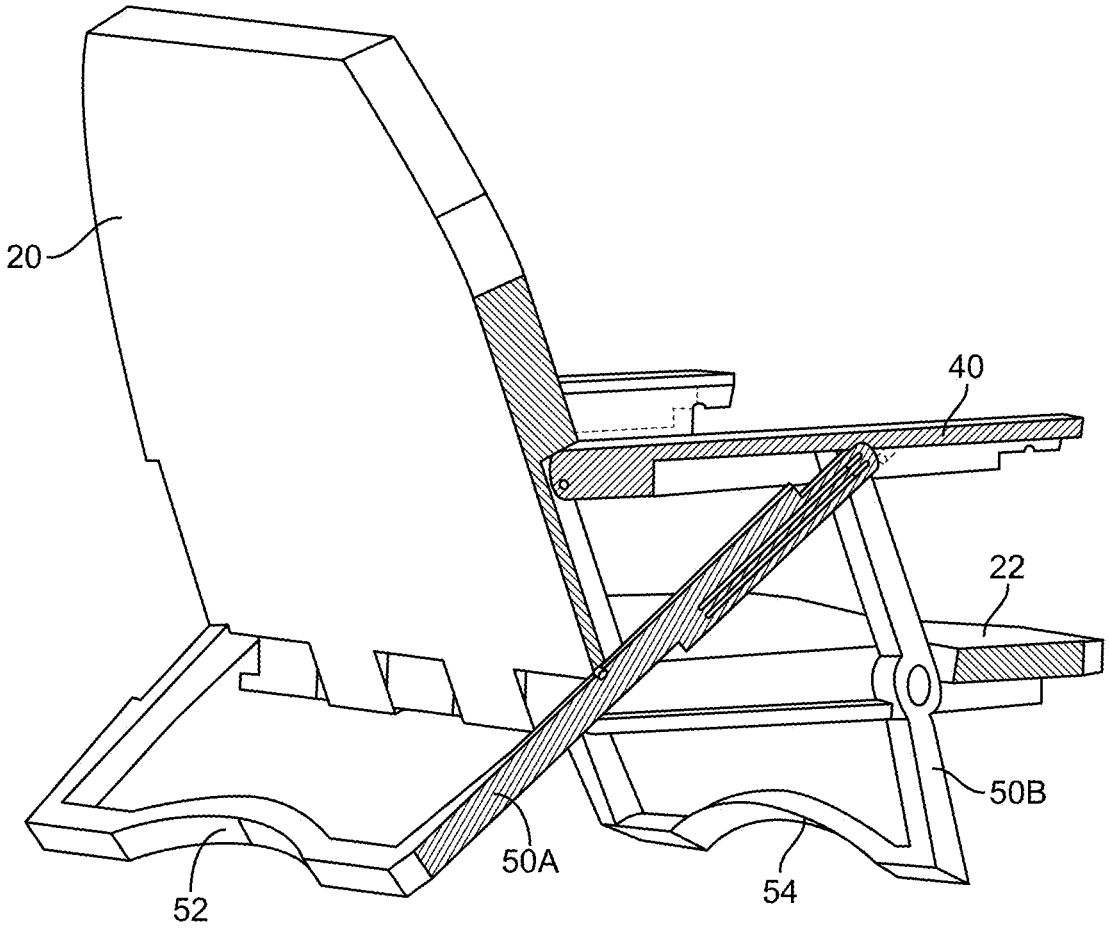
FIG. 14 is a rear perspective view corresponding to FIG. 13.
Figure 15:
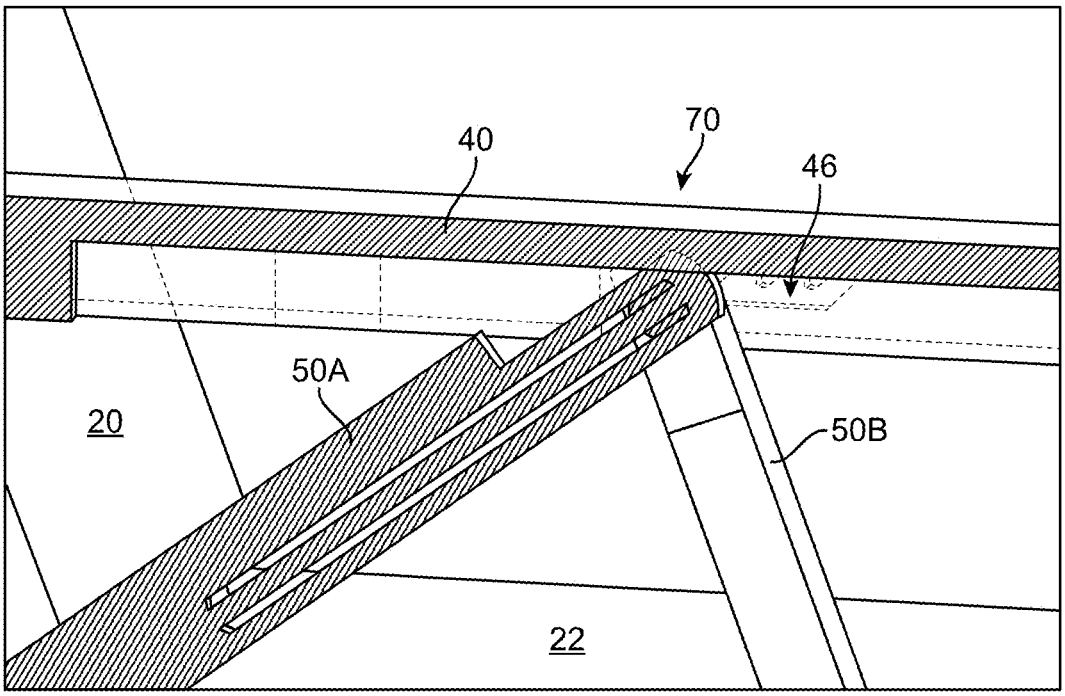
FIG. 15 is a close-up view of the chair leg mechanism of FIGS. 10 to 14.
Figure 16:
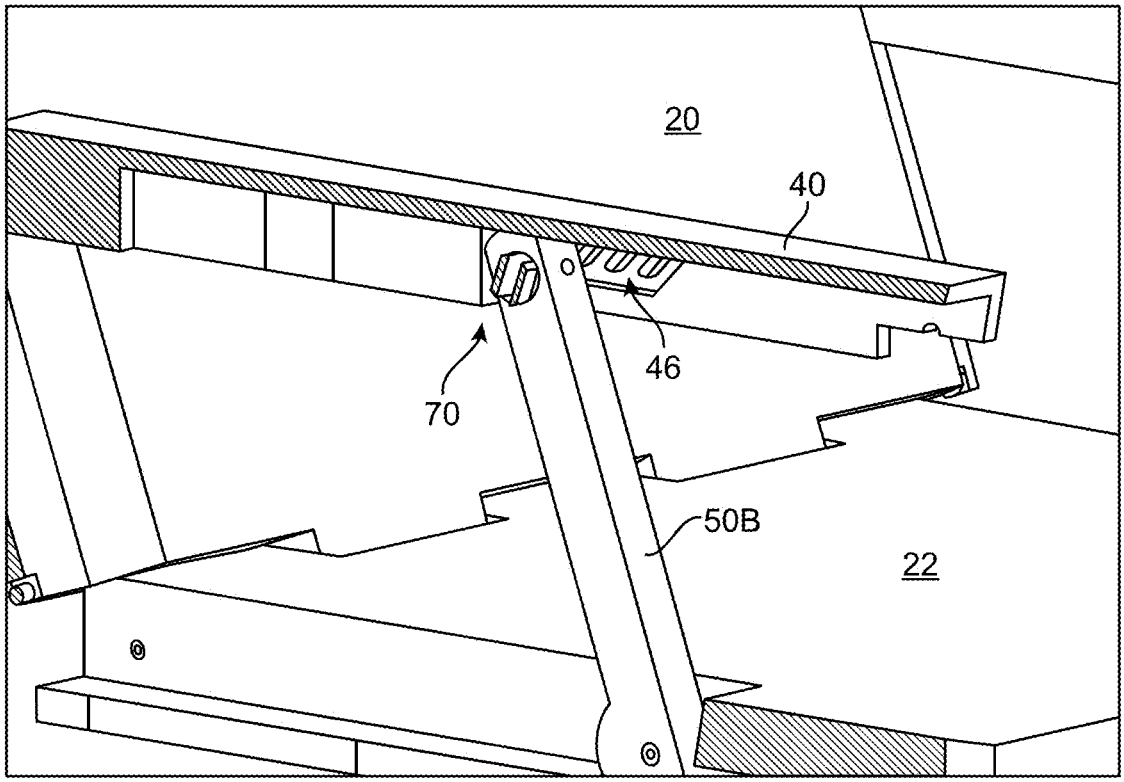
FIG. 16 corresponds to FIG. 15, but with the rear leg member removed to show operation of the various components.
Figure 17:
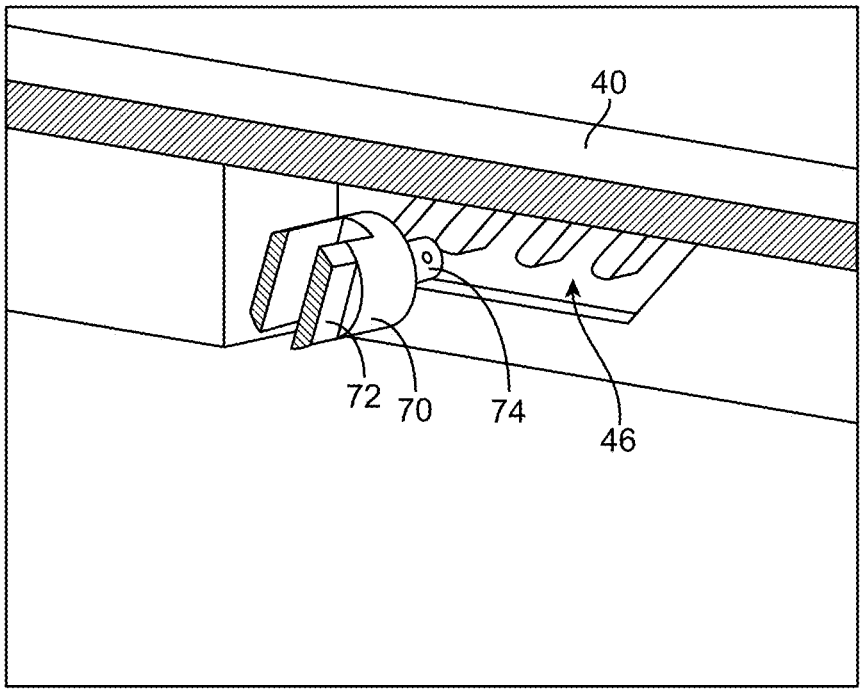
FIG. 17 corresponds to FIG. 16, but with all the leg members removed to show operation of the various components.
Figure 18:
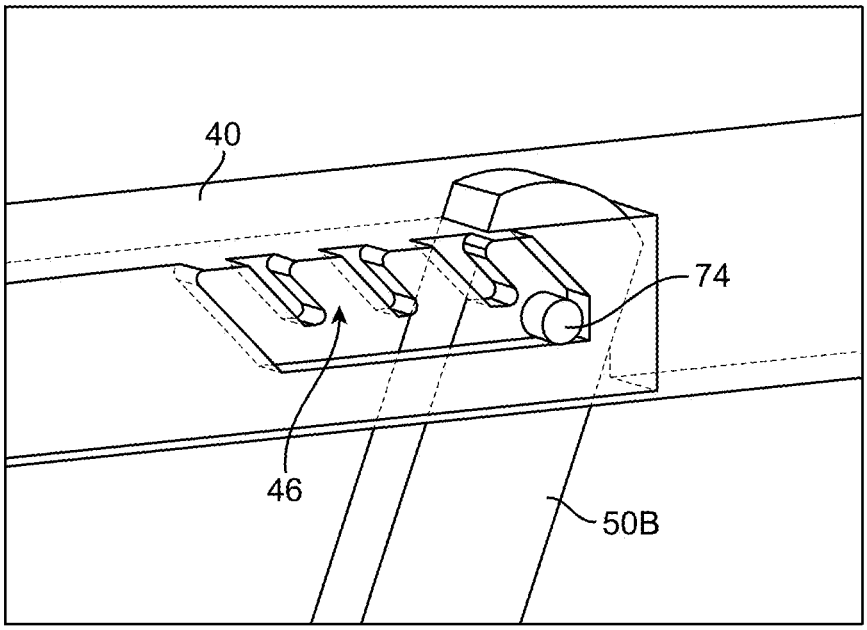
FIG. 18 is similar to FIG. 16, but the view is taken from inside the chair looking outwardly.

Lastly, FIGS. 10 to 18 illustrate a fourth embodiment of the present system. In this embodiment, the front and back legs 54 and 52 are both positioned at the rear end of the bodyboard when the device is in the bodyboard position of FIG. 10. As seen in FIG. 11, the user first extends leg member 50A (two leg members 50A are connected together to form rear leg 54). Next, as seen in FIG. 12, leg members 50A and 50B are rotated together to deploy armrests 40). Leg members 50B are connected together to form front leg 54, and leg members 50A and 50B sit parallel next to one another in the bodyboard position of FIG. 11. Next, as seen in FIG. 13, leg members 50A are rotated backwardly such that leg 52 is now positioned behind the chair, and the chair is now ready for use.

FIGS. 15 to 18 show further details of the positioning system 30 of the embodiment of FIGS. 10 to 14. As seen in these figures, leg members 50A and 50B are connected together at fastener 70. Fastener 70 has two raised portions 72 which are received into slots in leg member 50A. Fastener 70 also has a pin 74 which is received into a notched underside portion 46 in armrest 40. Fastener 70 is rotatable within an aperture in leg member 50B. As such, leg members 50A and 50B can be rotated with respect to one another around fastener 70 during deployment of the legs. In addition, fastener 70 can be moved to various positions within notched underside portion 46 in armrest 40, such that the angle of the back of the chair can be adjusted (i.e.: the angle of portions 22 and 24 with respect to one another can be adjusted by moving pin 74).

It is to be understood that the present invention encompasses those embodiments that would be obvious modifications to one skilled in the art.

What is claimed is:

1. A combination bodyboard and chair system, comprising:

a bodyboard front panel portion;

a bodyboard rear panel portion pivotally connected to the bodyboard front panel portion; and a folding mechanism configured to move the front and rear panel portions between a flat bodyboard position and an angled chair position;

wherein the folding mechanism comprises a pair of armrests and at least two legs; wherein the armrests are received into armrest openings in one or the other of the front or rear panel portions when the system is in the flat bodyboard position; and wherein the legs are received into leg openings at side edges of one or the other of the front or rear panel portions when the system is in the flat bodyboard position.

2. The system of claim 1, wherein the front and rear bodyboard panel portions are co-planar when the system is in the flat bodyboard position, and angled to one another when the system is in the angled chair position.

3. The system of claim 1, wherein the folding mechanism further comprises a pivoting connection between the bodyboard front and rear portions.

4. The system of claim 1, wherein the armrest openings are at side edges of one or the other of the front or rear panel portions.

5. The system of claim 1, wherein the folding mechanism further comprises:

four armrest support members, and four leg members.

6. The system of claim 5, wherein the four armrest support members and the four leg members are pivotally mounted to the bodyboard rear panel portion.

7. The system of claim 1, wherein the folding mechanism further comprises:

four leg members, wherein upper portions of the four leg members support the armrests.

8. The system of claim 1, wherein the folding mechanism further comprises:

two leg members, wherein upper portions of the two leg members support the armrests.

9. The system of claim 8, wherein the two leg members are rotatable with respect to one another, and the two leg members are rotatable around a moveable pivot point in the armrests.

10. The system of claim 1, wherein the folding mechanism further comprises leg members that are connected together in pairs to form a front leg and a back leg.

11. The system of claim 10, wherein the front leg and the back leg are received into openings extending across the bottom of one or the other of the front or rear panel portions when the system is in the flat bodyboard position.

12. The system of claim 10, wherein the front leg is angled out forwardly and the back leg is angled out backwardly when the system is in the angled chair position.

13. The system of claim 1, wherein each armrest is pivotally connected to the front panel portion.

14. The system of claim 13, further comprising a locking mechanism securing at least one of the armrests to the rear panel portion when the system is in the flat bodyboard position.

15. The system of claim 1, wherein the front and rear panel portions are made from extruded polypropylene.

* * * * *